US007052044B1

(12) United States Patent
Streeter

(10) Patent No.: US 7,052,044 B1
(45) Date of Patent: May 30, 2006

(54) RELEASABLE SKI TIP COUPLER

(75) Inventor: Jeffrey Streeter, Boise, ID (US)

(73) Assignee: Lucky Bums, Inc., Boise, ID (US)

( * ) Notice: Subject to any disclaimer, the term of this patent is extended or adjusted under 35 U.S.C. 154(b) by 0 days.

(21) Appl. No.: 11/160,081

(22) Filed: Jun. 8, 2005

(51) Int. Cl.
*A63C 5/65* (2006.01)

(52) U.S. Cl. ..... 280/818

(58) Field of Classification Search ..... 280/818, 280/817, 809, 816; 453/253; 482/71
See application file for complete search history.

(56) References Cited

U.S. PATENT DOCUMENTS

| | | | | |
|---|---|---|---|---|
| 3,264,663 | A * | 8/1966 | Owens | 441/73 |
| 3,567,239 | A * | 3/1971 | Kitterman | 280/818 |
| 3,703,299 | A * | 11/1972 | Kutchma | 280/818 |
| 3,992,022 | A * | 11/1976 | Albers | 280/818 |
| 4,275,904 | A * | 6/1981 | Pedersen | 280/818 |
| 4,828,288 | A * | 5/1989 | Humbert | 280/818 |
| 4,936,603 | A * | 6/1990 | Reynaud | 280/818 |
| 5,531,480 | A * | 7/1996 | Foertsch | 280/818 |

FOREIGN PATENT DOCUMENTS

FR 2609901 A1 * 7/1988

OTHER PUBLICATIONS

Apple Rise Sports: KID-SKI Tip Lock. Photograph [online]. AppleRise.com. Retrieved from the Internet on May 3, 2005.
<URL: http://www.applerise.com/merchant2/merchant.mv?Screen=PROD&Store_Code=ARS &Product_Code=1401-TLOK>.
Apple Rise Sports—Tip Lock. Photograph [online]. Altrec.com. Retrieved from the Internet on May 3, 2005.
<URL: http://mirror.altrec.com/images/shop/photos/APP/11887_.jpg>.

* cited by examiner

*Primary Examiner*—J. Allen Shriver
(74) *Attorney, Agent, or Firm*—Your Intellectual Property Matters, LL; Robert A. Frohwerk

(57) ABSTRACT

This Releasable Ski Tip Coupler interconnects a pair of skis, especially snow skis, in order to maintain proper spacing of the tips of the skis for training inexperienced skiers, especially children. The coupler allows the user to vary the separation of the tails of the skis without danger of a fall caused by crossing of the ski tips. The coupler comprises two sets of straps, one set to encompass each of the right and left skis. One strap from each set engages an aperture provided near the tip of each ski, while other straps may serve to secure the aperture-engaging strap from disconnecting during use. The two sets of straps are joined to one another by a releasable buckle to allow quick separation of the two skis when desired. Straps and buckle are sized to maintain proper spacing of the ski tips for the trainee.

20 Claims, 5 Drawing Sheets

RELEASABLE SKI TIP COUPLER

BACKGROUND OF THE INVENTION

Beginning snow skiers often have difficulty learning to keep the tips of their skis together. In the best of situations a natural walking stance when superimposed onto a pair of skis would result in skis that are parallel. Unfortunately, it is far more likely that donning a pair of skis will naturally result in outward pointing ski tips, which will have the catastrophic consequence of causing the inexperienced skier to do the splits and fall.

Although teaching styles have varied over time and from one ski slope to another, most skiers will begin by mastering the snowplow, or wedge, before learning to keep their skis parallel. The snowplow maneuver has the tips of the skis pointing inward with the tails further apart than the tips. In this position the skier tends to place more weight on the inner edges of the skis resulting in a controlled descent of the ski slope. The angle of the skis is useful to control the skier's speed, even to a stop. A wider angle with the tails of the skis relatively much further apart than the tips will traverse the slope much more slowly than a narrower angle. The goal of the beginning skier is to graduate to skiing with skis parallel.

Several ski training devices have been patented for maintaining spacing between skis. Zemke's U.S. Design Pat. No. D366,083 shows a pair of loops separated by a spacer. One of these devices will slip over the tips of the skis and another over the tails, apparently to maintain parallelism between skis. In U.S. Pat. No. 3,171,667 Wightman describes a pair of spring-loaded connector rods that that allow restrained motion while generally holding the skis parallel to one another. Another patent by Wightman (U.S. Pat. No. 3,751,056) shows a special connector that may be used with his earlier patented device to allow the connector rods to be removed leaving pairs of receptacles that had been either glued or screwed to the upper surfaces of the skis.

The Ski Trainer of Charneck's U.S. Pat. No. 3,907,320 uses turnbuckle-like connecting rods that have their ends attached to clamps that grip the edges of the skis. With one such device near the tips of the skis and another near the tails, a pair of skis can be adjusted from a wedge to a parallel configuration by adjusting the length of the turnbuckles. Other patented devices add to a pair of skis complexities such as handlebars.

One of the most common and simplest devices that has been used for teaching beginning skiers to keep their ski tips together in order to form a wedge is known as the Edgy Wedgy. This is a plastic molded device not unlike a short piece of rubber hose with a screw clamp on each end. The clamps fasten to the tips of the skis with the body of the device lying between the skis so as to keep the tips of the skis closer together than the tails without allowing the skis to cross. When used to teach a child to ski, such a device is attached to the child's skis and the instructor, or parent, will ski backward in front of the child using a ski pole placed against the hose or ski tips to control the child's motion. The major drawback of this device is that the clamps tend to work loose due to vibration and cold weather. When tightened sufficiently to serve their purpose, the clips may mar or gouge the surfaces of the skis, though this is merely a cosmetic and not a functional issue.

The Tip Lock™ Ski Accessory by Apple Rise Sports includes adhesive strips that are applied to each ski to affix a loop portion of a hook and loop fastener. The mating hook portion of the fastener is sewn onto webbing that wraps around the tip of each ski. Two such straps, one for each ski, are connected by a buckle to keep the ski tips together in a wedge shape. The self-adhesive loop tape that attaches to the skis can be removed without damaging the skis, presumably when the skier graduates beyond the training phase.

Many of these devices involve an excessive number of components, rendering them expensive, cumbersome, unattractive and difficult to operate under winter conditions. Devices appropriate for use in a training situation, whether by the trainee or the trainer, need to be easily manipulated by a user wearing bulky mittens with a minimum of effort. They should be inexpensive, easy to attach to skis, have a minimum number of parts, and be easily carried when not in use. It will be showing that the present invention incorporates all of these characteristics while improving upon the security and stability of some of the better previous designs.

BRIEF SUMMARY OF THE INVENTION

The disclosed invention couples a pair of skis near their upturned tips so as to hold the skis in a wedge configuration without allowing the tips to cross. This is useful for training inexperienced skiers to snowplow. Past devices have required that various connectors or receptacles be clamped, screwed or glued to the skis. The device of the present invention takes a different approach in that nothing must be added to the skis themselves to facilitate use of the invented coupler. It is the intent of the present invention to rely on ski manufacturers to provide a small aperture in the upturned tip of each ski for reception of the invented coupler. The required apertures may take the form of a round hole or a slot. During a transitional phase, before the manufacturing details are worked out, the apertures may be generated at a retail outlet or by an owner of the skis, by drilling or punching.

The invented coupler interconnects the skis using two sets of straps joined by a buckle. Each of the two sets of straps is attached to a ski. The buckle comprises a female portion and a disconnectable male portion so that the two skis may be easily separated without removal of the straps from their respective skis.

In each set of straps a central aperture-engaging strap engages the aperture of a ski. An outer strap in each set loops through the buckle and extends outward to wrap around the ski and capture the aperture engaging strap into a kind of sandwich. Hook and loop fasteners on all straps provide a locking mechanism to retain a ski and keep it from twisting loose. The described ski tip coupler provides a positive but reversible means of connecting two skis together in a manner that can be easily removed to return the skis to their original condition when the coupler is no longer needed.

BRIEF DESCRIPTION OF THE DRAWINGS

The particular features and advantages of the invention as well as other objects will become apparent from the following description taken in connection with the accompanying drawings, in which.

Figure 1:
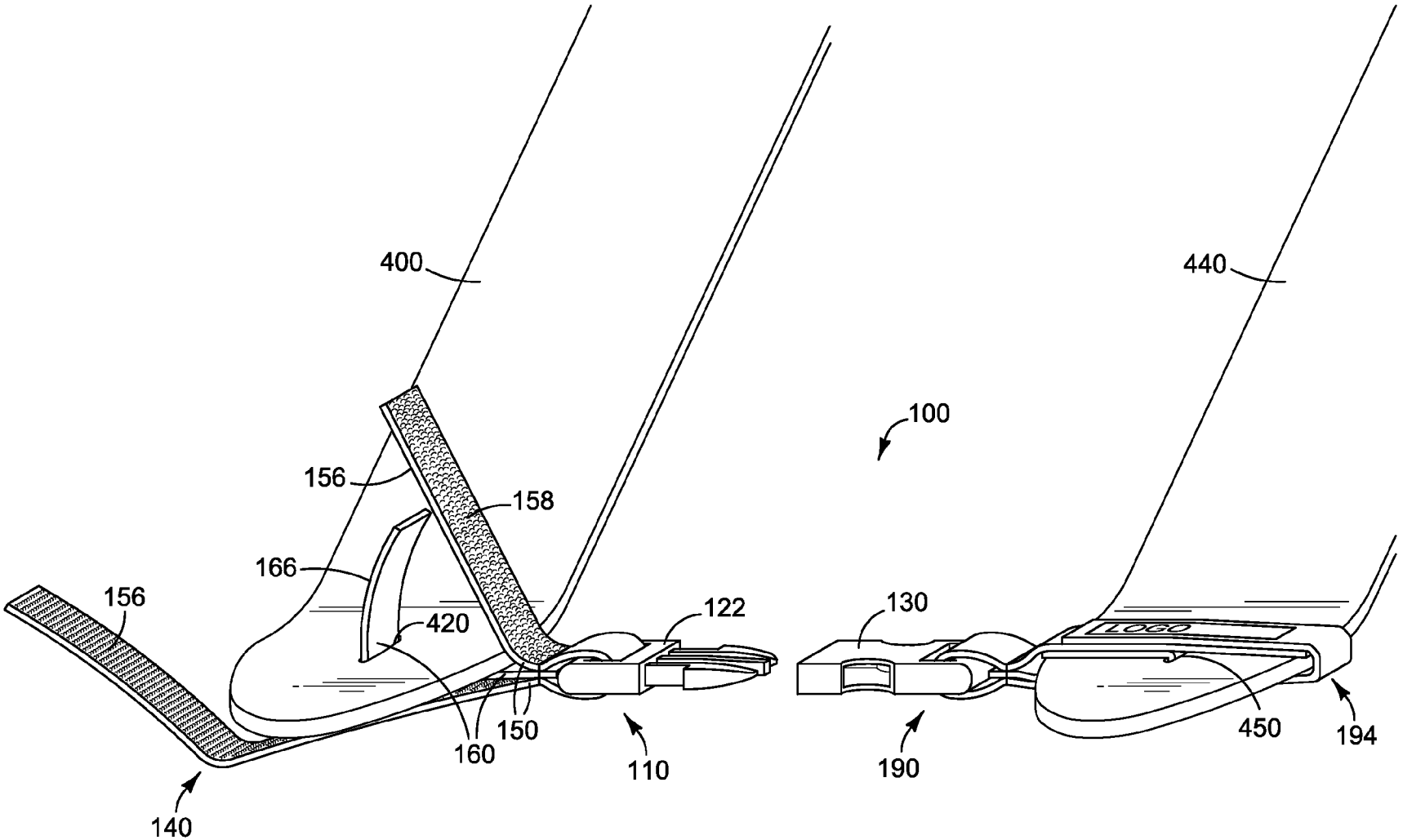
FIG. 1 shows a perspective view of the coupler in use on a left ski with a right ski in the process of being connected.
Figure 2:
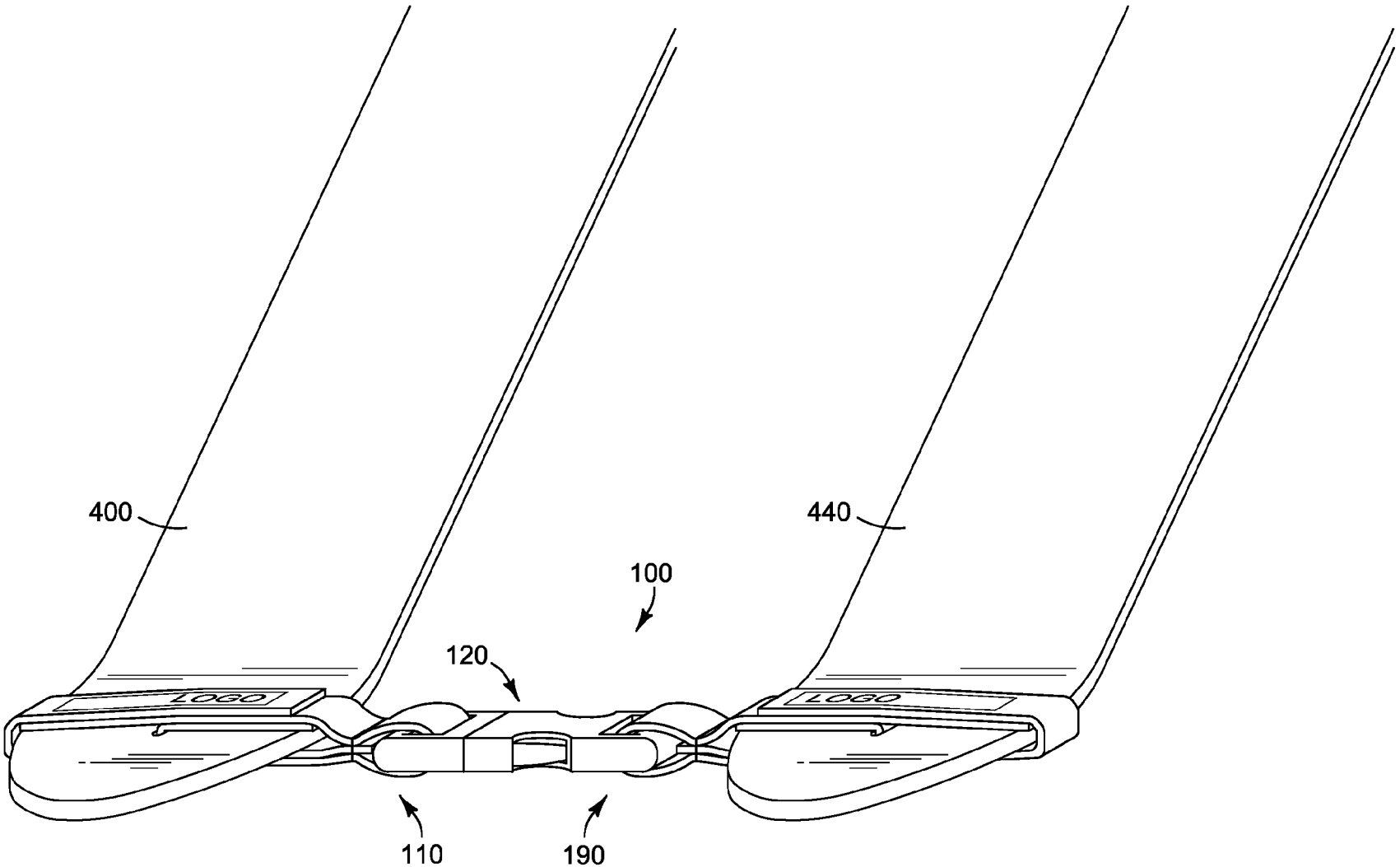
FIG. 2 is a perspective view of the coupler on a pair of skis ready for use.

The following Reference Numbers may be used in conjunction with one or more of the accompanying FIGS. 1–11 of the drawings:

100. Coupler
110. Coupler, right half
120. Buckle, disconnectable
122. Buckle, male portion
124. Buckle mounting region, male
126. Buckle connection region, male
130. Buckle, female portion
134. Buckle mounting region, female
136. Buckle connection region, female
140. Strap set, right
150. Long strap
152. Shorter end of long strap
154. Longer end of long strap
155. Loop of long strap
156. Hooked surface of long strap
158. Looped surface of short end of long strap
160. Short strap
162. End of short strap nearer buckle
164. Open end of short strap away from buckle
166. Looped surface of short strap
170. Stitching to hold straps to buckle
190. Coupler, left half
194. Strap set, left
400. Ski, right
410. Lower surface of (right) ski
420. Aperture in tip of right ski
430. Upper surface of (right) ski
440. Ski, left
450. Aperture in tip of left ski

DETAILED DESCRIPTION OF THE INVENTION

The present invention is primarily a training device to aid in teaching an inexperienced person to ski. As such the described coupling device maintains a pair of snow skis in a wedge configuration with the tips closer to one another than the tails. This is accomplished by attaching the invented coupler near the tips of the two skis. Attachment of the coupler to the skis is accomplished without screws, clamps or glue. Use of the described coupler assumes that each ski has an aperture in its upturned tip for reception of a member of the coupler.

An overview of the disclosed coupler 100 is shown in FIG. 1 where a right ski 400 is in the process of being connected to the right half 110 of the coupler 100 and a left half 190 of the invented coupler has been fully connected to the tip of a left ski 440. The right-hand portion 110 of coupler 100 in the preferred embodiment is seen to comprise a right-hand disconnectable male portion 122 of buckle 120 and one of two identical sets of straps 140. Corresponding components in the left-hand portion 190 of coupler 100 are a female portion 130 of buckle 120 and a second, left-hand set 194 of straps. Each of the two buckle portions 122 and 130 has a mounting region 124 and 134 and a connection region 126 and 136. A first set of straps 140, which will be used with a left ski 440, is shown attached to the female portion 130 of the buckle 120, whereas a second set of straps 194 associated with the male portion 122 of the buckle will attach to a right ski 400. Once installation of the coupler 100 to both skis has been completed, the two halves 122 and 130 of the buckle 120 are connected as in FIG. 2 and the training session may begin.

Figure 3:
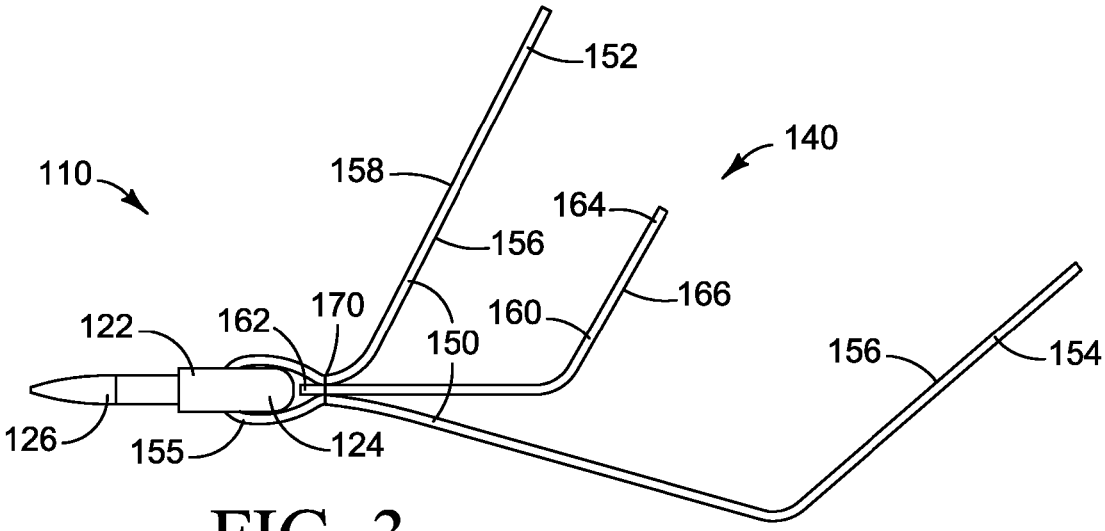
FIG. 3 shows in elevation one half of a coupler with the male portion of a buckle and with the fastenable surfaces of the straps separated prior to installation onto a ski.

Since the two sets of straps 140 and 194 are mirrored images of one another, this description will refer primarily to the right-hand set of straps 140 beginning in FIG. 3. Each set of straps comprises a long strap 150 and a short strap 160. One surface of the long strap 150 is completely covered with the hook portion 156 of a hook and loop fastener. The long strap is then looped 155 through the mounting region 124 of the appropriate buckle portion 122 and folded back onto itself so that the hooked surface 156 is folded to the inside, leaving two open ends, one end 154 being longer than the other 152. The short strap 160 receives a loop portion 166 of a hook and loop fastener before it is placed between the two open ends 152 and 154 of the long strap 150 with one end 162 of the short strap 160 near the buckle 120, and its looped surface 166 against the longer 154 of the two open ends of the long strap 150.

This stack of three layers, two 152 and 154 from the looped long strap 150 with the short strap 160 between, is permanently gathered and bound 170 so as to prevent its removal from the buckle 120. Since the straps in the preferred embodiment are made of a webbing material, it is convenient to gather and bind 170 the layers together by stitching with an appropriate weight of thread or cord. With this much of the assembly process accomplished for each of the two sets of straps 140 and 194, each of the two buckle portions 122 and 130 has been successfully attached to a set of straps leaving three open, unconnected, strap ends (152, 164 and 154). The short end 150 of the long strap 150 is fitted with an additional segment of loop portion 158 of a hook and loop fastener facing upward, or outward, away from the stack of open ends. At this point the described coupler 100 has been fully assembled and is ready for use.

Figure 4:
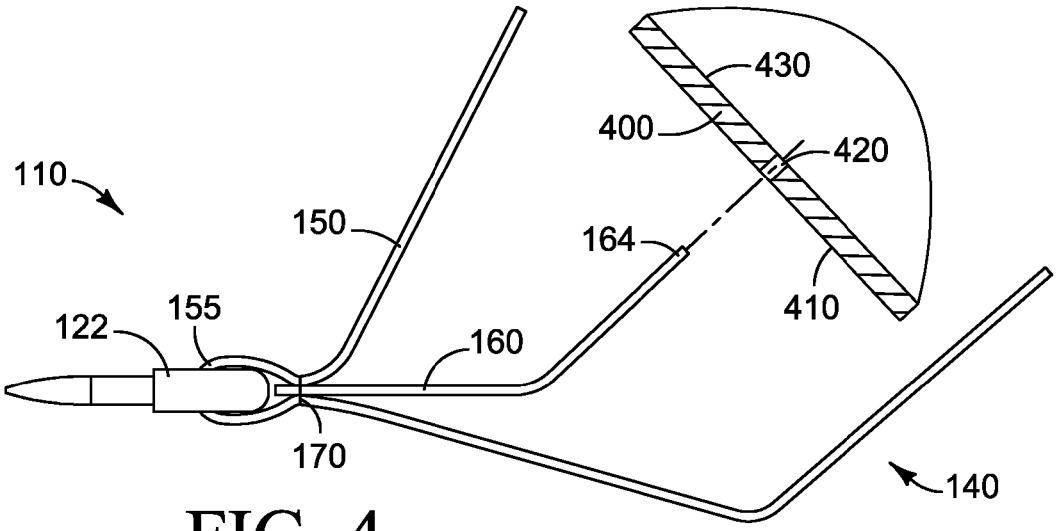
FIG. 4 depicts the aperture-engaging strap ready for insertion into the aperture near the tip of a ski.
Figure 5:
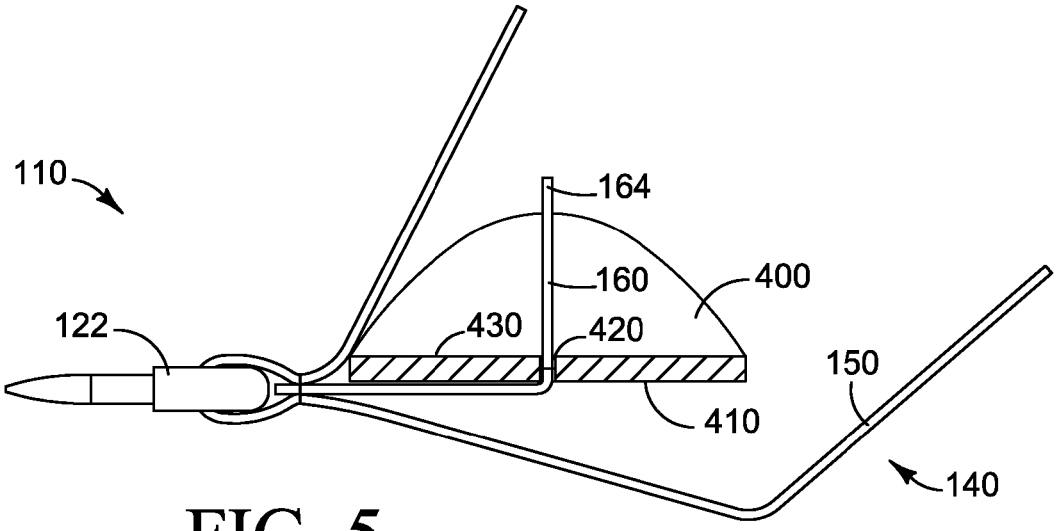
FIG. 5 shows the ski seated onto the aperture-engaging strap.
Figure 6:
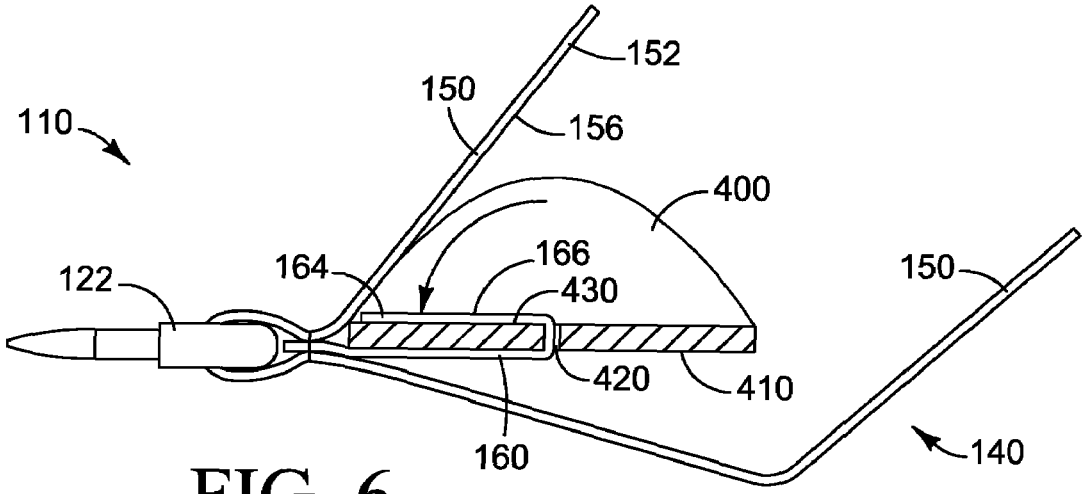
In FIG. 6 the aperture-engaging strap has been folded back across the top surface of the ski.
Figure 7:
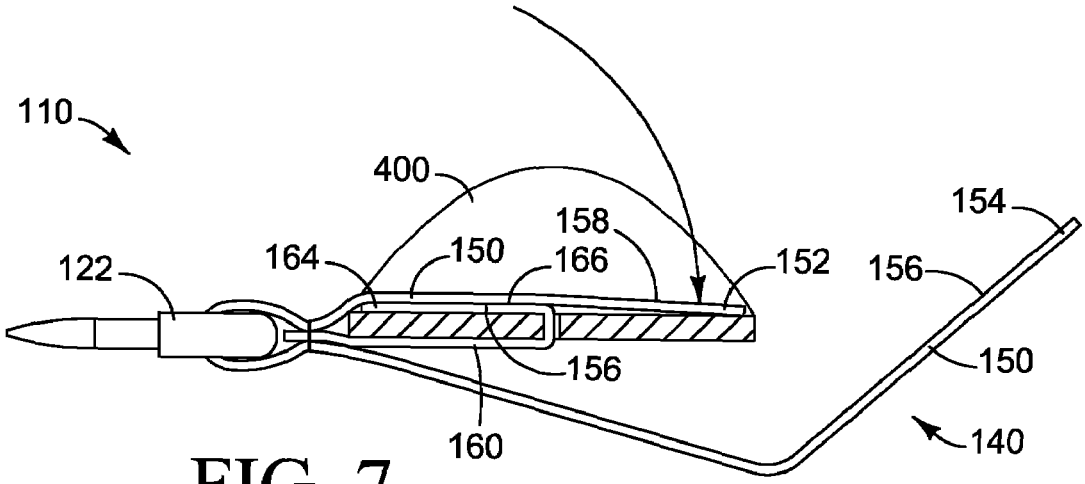
FIG. 7 depicts the short end of the buckle-attached strap overlaid onto the top of the ski capturing the aperture-engaging strap.
Figure 8:
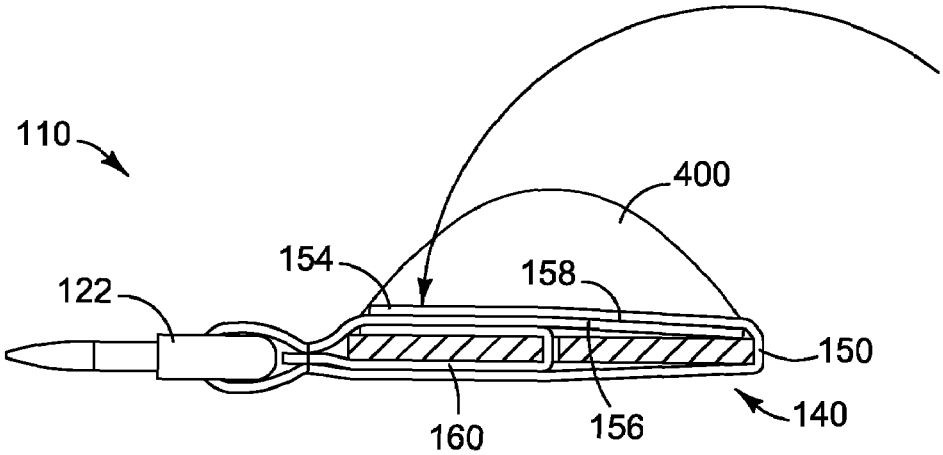
FIG. 8 shows the long end of the buckle-attached strap wrapped around the outer edge of the ski and back over the top of the short end to sandwich all straps together.

To install the presently invented coupler onto a pair of skis, it is best to separate the left 190 and right portions 110 of the coupler 100 by disconnecting the male portion 122 of the buckle 120 from the female portion 130. In this manner the left 110 and right portions 190 of the coupler 100 can be installed independently to the left 440 and right skis 400 with minimal interference. Installation begins as depicted in FIG. 4 by placing the lower surface 410 of a ski above the open end 164 of the center of the three straps 160 with the inner edge of the ski nearer the buckle 120. This central strap 160 is then fed through the aperture 420 of the ski 400 from the underside as in FIG. 5. The aperture-engaging strap 160 is then folded back over the top of the ski toward the buckle, FIG. 6. The shorter end 152 of the long strap 150, which until now has been held out of the way, is pulled across the top 430 of the ski 400, as shown in FIG. 7, so that the hooked surface 156 of the strap engages the looped surface 166 of the aperture-engaging strap 160. At this point the ski is securely fastened to the buckle half 122. To complete the installation (FIG. 8), the longer end 154 of the long strap 150 is extended across the underside 410 of the ski 400, wrapped around the ski's outer edge, and folded back over the top 430 of the ski so that the hooked surface 156 of this longer end 150 engages the looped surface 158 at the top of the shorter end 152. Closure of this last strap supports the outer edge of the ski and increases stability of the entire installed assembly.

Figure 9:
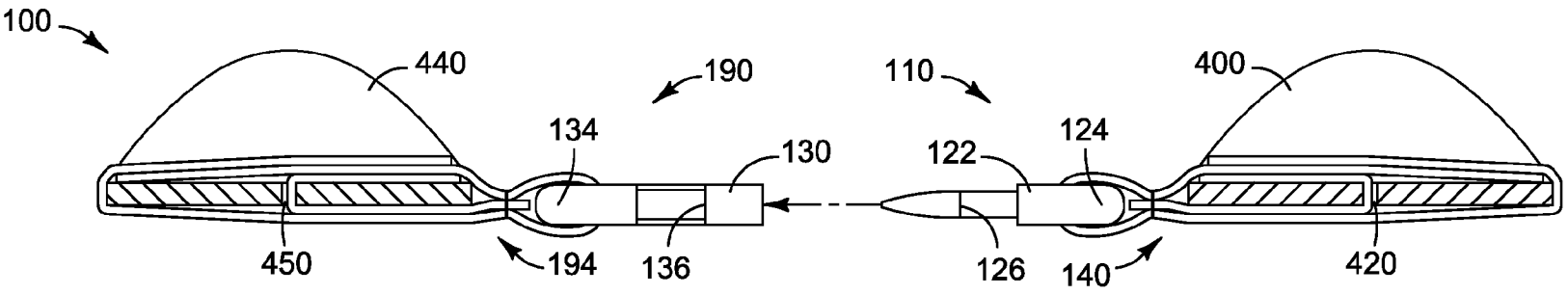
FIG. 9 is a side elevation of the two halves of the coupler each installed onto their respective skis.
Figure 10:
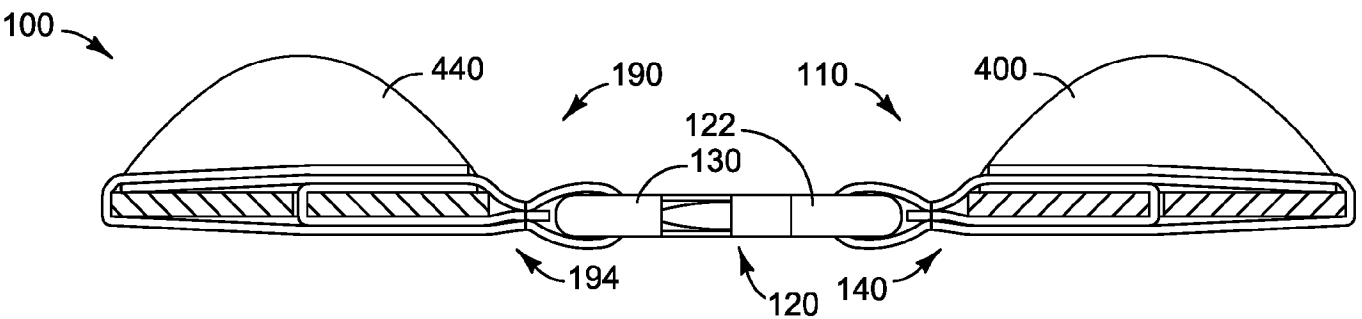
FIG. 10 shows a completed installation with the buckle in a closed condition ready to be used for training.

After both skis 400 and 440 have been installed to their corresponding coupler portions 110 and 190 as depicted in FIG. 9, the male 126 and female portions 136 of the buckle 120 are then reconnected to one another to couple the skis (FIG. 10) and ready them for use in the desired training exercise.

Figure 11:
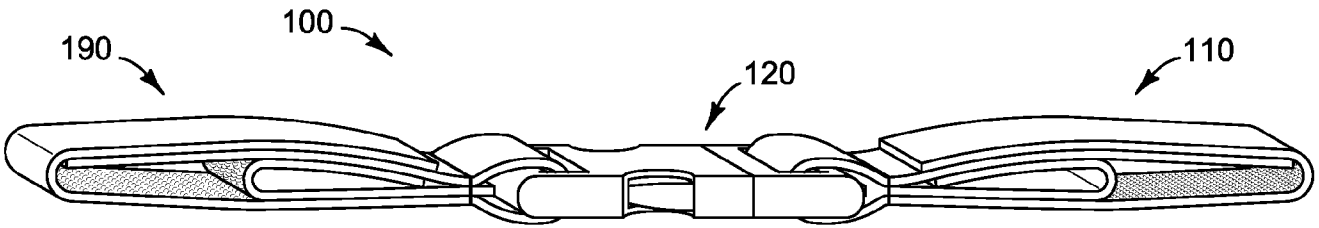
FIG. 11 is a perspective view of the coupler in condition for sales, shipment or storage.

Although the coupler 100 has been described primarily as a training device, other applications will be apparent once the coupler has been installed onto a pair of skis. One alternative use is as a convenient means of carrying the skis. Another use is to keep the skis from being separated from one another and lost when they are not being worn. The coupler 100 stores compactly as shown in FIG. 11 with all fastenable surfaces covered to avoid exposure to tangling or sticking to other such couplers or debris. This compact storage configuration will be appreciated in the sales channel prior to purchase, as well as by an end user after a ski training session.

The present invention relies heavily on the strength, flexibility and ease of use of fasteners of the hook and loop type. Although the preferred embodiment has been described with a particular layout and sequence with regard to the locations of the hooked and looped portions of such fasteners, it will be recognized that an alternate embodiment may interchange the two genders with equivalent results. However, where such an exchange is made, all hooked surfaces must be completely replaced with loops and vice versa so as to maintain fastenability.

The type of buckle shown for purposes of illustration of the preferred embodiment is a plastic one that is commonly used for outdoor clothing, camping gear and related accessories. Those familiar with such articles will recognize that other two-part separable connectors may be substituted without altering the functionality of the described invention.

While the present invention has been described with respect to a preferred embodiment, there is no implication to restrict the present invention to preclude other implementations that will be apparent to those skilled in the related arts. It is easily recognized that the described invention may be implemented with a variety of components, therefore, it is not intended that the invention be limited to the disclosed embodiments or to the specifically described details insofar as variations can be made within the spirit and scope of the appended claims.

What is claimed is:

1. In combination with a pair of skis, each of the skis having an upturned tip with an aperture therein, a coupler for interconnecting the skis, the coupler comprising:

a buckle and two sets of straps, wherein said buckle comprises a female portion and a disconnectable male portion; and an aperture-engaging strap from a first of said two sets of straps engages the aperture of a first ski from said pair of skis;

an aperture-engaging strap from a second of said two sets of straps engages the aperture of a second ski from said pair of skis;

a buckle-attached strap from a first of said two sets of straps is bound to said female portion of said buckle; and a buckle-attached strap from a second of said two sets of straps is bound to said disconnectable male portion of said buckle.

2. The coupler in claim 1 wherein the two aperture-engaging straps are each bound respectively to the buckle-attached straps within the same set of straps.

3. The coupler in claim 1 wherein the buckle-attached strap and an end of the aperture-engaging strap within each set of straps are bound in common to a corresponding portion of said buckle and open ends of the straps not being so commonly bound have a fastening means for fastening the open end of the aperture-engaging strap to the open end of the buckle-attached strap within the same set of straps.

4. The coupler in claim 3 wherein said fastening means is a hook and loop fastener.

5. The coupler in claim 1 wherein each of the straps within each of said two sets of straps is attached at one end either directly or indirectly to a corresponding portion of said buckle leaving an open end of each strap to be fastened to one or more of the open ends of the straps within said set of straps.

6. The coupler in claim 5 wherein each of said two sets of straps comprises three open ends.

7. The coupler in claim 6 wherein within each of said two sets of straps the open end of a central strap is the aperture-engaging strap.

8. The coupler in claim 7 wherein the open end of each of the aperture-engaging straps enter the apertures from a first surface of a corresponding ski, and a strap from within said set of straps that is adjacent to a second surface of a corresponding ski opposite the first surface fastens to the aperture-engaging strap subsequent to the engagement of the aperture.

9. The coupler in claim 8 wherein the fastening is accomplished by a hook and loop fastener.

10. The coupler in claim 8 wherein a strap that is adjacent to the first surface from within said set of straps spans the first surface of a corresponding ski, wraps around an outer edge of the ski, and folds back over the second surface of the ski to encompass and fasten to both of the other straps within said set of straps.

11. The coupler in claim 10 wherein the fastening is accomplished by one or more instances of hook and loop fasteners.

12. The coupler in claim 7 wherein the open end of each of the aperture-engaging straps enters the aperture from a lower surface of a corresponding ski, and an upper strap from within said set of straps fastens to the aperture-engaging strap at an upper surface of a corresponding ski.

13. The coupler in claim 12 wherein the fastening is accomplished by a hook and loop fastener.

14. The coupler in claim 12 wherein a lower strap from within said set of straps spans an underside of a corresponding ski, wraps around an outer edge of the ski, and folds back over an upper surface of the ski to encompass and fasten to both of the upper strap and the aperture-engaging strap within said set of straps.

15. The coupler in claim 14 wherein the fastening is accomplished by one or more instances of hook and loop fasteners.

16. The coupler in claim 1 for the purpose of interconnecting the skis to assist in training an inexperienced skier.

17. The coupler in claim 1 for the purpose of interconnecting the skis so as to avoid crossing of the tips one over the other when the skis are in use.

18. The coupler in claim 1 wherein said pair of skis is snow skis.

19. The coupler in claim 5 wherein each of said two sets of straps comprises three open ends which may be laid flat one upon another in a stack when not in use.

20. A method of coupling a pair of skis, each ski of said pair of skis having an aperture in its tip, the method of coupling comprising:

inserting a first aperture-engaging strap through the aperture of a first ski from said pair of skis to a midpoint along the length of said first aperture-engaging strap;

folding of both ends of said first aperture-engaging strap toward an inner edge of said first ski;

overlaying a first end of a first buckle-attached strap upon a first surface of said first ski so far from the inner edge of said first ski as to superimpose at least that portion of said first surface of said first ski which is covered by said first aperture-engaging strap, the overlay of said first buckle-attached strap with said first aperture-engaging strap resulting in a first fastenable connection;

looping an unconnected second end of said first buckle-attached strap though a first mounting region of a buckle, extending said first buckle-attached strap to superimpose the entire width of said first ski at a second surface of said first ski capturing the unconnected portion of said first aperture-engaging strap in a second fastenable connection;

wrapping said second end of said first buckle-attached strap around an outer edge of said first ski and back over the first surface of said first ski to capture an outward facing portion of the first end of said first buckle-attached strap in a third fastenable connection; and repeating all of the steps of inserting, folding, overlaying, looping and wrapping for a second ski from said pair of skis, a second aperture-engaging strap, a second buckle-attached strap, and a second mounting region of a buckle.

* * * * *